US007526820B2

(12) United States Patent
Murdock et al.

(10) Patent No.: US 7,526,820 B2
(45) Date of Patent: May 5, 2009

(54) SWIMMING MACHINE

(76) Inventors: James Murdock, 200 Dutton Mill Rd., Aston, PA (US) 19014; Thomas M. Zuraw, 200 E. Dutton Mill Rd., Aston, PA (US) 19014; Linda S. Braley, 200 E. Dutton Mill Rd., Aston, PA (US) 19014

( * ) Notice: Subject to any disclaimer, the term of this patent is extended or adjusted under 35 U.S.C. 154(b) by 706 days.

(21) Appl. No.: 11/207,044

(22) Filed: Aug. 18, 2005

(65) Prior Publication Data

US 2007/0039092 A1 Feb. 22, 2007

(51) Int. Cl.
*E04H 4/00* (2006.01)

(52) U.S. Cl. ..... 4/492; 4/904; 415/211.2

(58) Field of Classification Search ..... 4/492, 4/904; 417/390; 415/211.2
See application file for complete search history.

(56) References Cited

U.S. PATENT DOCUMENTS

| | | | | |
|---|---|---|---|---|
| 1,630,797 | A | | 5/1927 | Marwick |
| 1,992,891 | A | | 2/1935 | Schmidt |
| 2,035,835 | A | | 3/1936 | Raber |
| 3,534,413 | A | | 10/1970 | Plasseraud |
| 3,674,020 | A | | 7/1972 | Jacuzzi |
| 3,820,173 | A | | 6/1974 | Weller |
| 4,350,476 | A | * | 9/1982 | Eller ..... 417/390 X |
| 4,352,215 | A | | 10/1982 | Laing |
| 4,561,133 | A | | 12/1985 | Laing |
| 4,665,572 | A | | 5/1987 | Davidson |
| 4,938,469 | A | | 7/1990 | Crandell |
| 5,005,228 | A | | 4/1991 | Mermelstein |
| 5,044,021 | A | | 9/1991 | Murdock |
| 5,207,729 | A | | 5/1993 | Hatanaka |
| 5,298,003 | A | | 3/1994 | Weihe |
| 5,597,288 | A | | 1/1997 | Hatanaka |
| 5,662,558 | A | | 9/1997 | Shannon |
| 5,921,892 | A | | 7/1999 | Easton |
| 6,030,180 | A | | 2/2000 | Clarey |
| 6,789,278 | B2 | | 9/2004 | Shea |

* cited by examiner

*Primary Examiner*—Robert M Fetsuga
(74) *Attorney, Agent, or Firm*—Robert J. Yarbrough

(57) ABSTRACT

The Invention is a swimming machine operated by a hydraulic pump and hydraulic motor. A first and a second tubular rail support the swimming machine in a swimming pool and are configured to resemble a swimming pool ladder and thus disguise the swimming machine. The configuration of the tubular rails substantially prevents use of the swimming machine as a ladder. A radio-operated remote control proportional relief valve selectably bleeds hydraulic fluid from the high pressure side to the low pressure side of the hydraulic pump, allowing remote control of the velocity of water in the pool.

12 Claims, 8 Drawing Sheets

SWIMMING MACHINE

I. BACKGROUND OF THE INVENTION

A. Field of the Invention

The Invention is a swimming machine to allow a person to swim in place against a current of water created by the swimming machine. The swimming machine of the Invention allows a swimmer to remotely control the velocity of the current against which the person swims. The swimming machine of the Invention also blends in to the expected appearance of a swimming pool by providing mounting rails similar in appearance to those of a conventional swimming pool ladder. The configuration of the rails prevents a person from mistaking the swimming machine as a ladder.

B. Description of the Related Art

Most swimming pools are not suitable for swimming because of the small size of the pools. A person attempting to swim in such a swimming pool is required to turn after only a few strokes, interrupting the person's exercise and presenting the possibility of collision with the interior wall of the pool. Swimming machines address this problem by creating a current of water within the swimming pool against which the person may swim while remaining stationary with respect to the swimming pool. A very small swimming pool may thus be used for uninterrupted distance swimming.

Prime examples of the swimming machines of the existing art are the swimming machines produced by Endless Pools, Inc., 200 E. Dutton Mill Rd. Aston, Pa. 19014. See U.S. Pat. No. 5,044,021 to Murdock issued Sep. 3, 1991.

The prior art swimming machines do not teach the mounting system or the control system of the present Invention.

II. SUMMARY OF THE INVENTION

The Invention is a swimming machine. An impeller is mounted below the surface of the water of a swimming pool. A hydraulic motor turns the impeller, creating a current of water in the swimming pool against which a person may swim. A hydraulic pump creates a flow of hydraulic fluid to turn the hydraulic motor. A proportional relief valve selectively bleeds hydraulic fluid from the high pressure side to the low pressure side of the hydraulic pump and around the hydraulic motor, throttling the flow of fluid to the hydraulic motor. The proportional relief valve controls the speed of the hydraulic motor and thus the speed of the impeller and the velocity of the current of water. A remote control system comprising a radio remote control transmitter and a radio receiver operates the proportional relief valve. The swimmer or another person may use the remote control transmitter to control the speed of the current of water against which the person swims.

The swimming machine is mounted on a side of a swimming pool using two tubular rails. The two tubular rails extend above the surface of the water of the swimming pool and engage the deck of the swimming pool. The two tubular rails are configured to resemble a conventional swimming pool ladder in profile. The configuration of the rails disguises the two tubular rails and the swimming machine as a conventional ladder, allowing the swimming machine to blend into the expected appearance of the swimming pool.

The two tubular rails are configured to contact the swimming pool deck at a location adjacent to one another. Placing the tubular rails adjacent to one another on the swimming pool deck prevents a person from passing between the two tubular rails and creates a visual cue to the person that the swimming machine is not a conventional ladder, even though the tubular rails resemble a ladder in profile. The configuration of the tubular rails thus protects both the swimming machine and the person. The barrier created by the configuration of the tubular rails is not complete. Depending on the specific configuration selected for the two tubular rails, the person still may climb over the tubular rails or crawl under the tubular rails to gain access to the swimming pool deck between the two tubular rails and the housing for the swimming machine.

Configuration of the tubular rails to resemble a conventional ladder serves to facilitate installation, service and storage of the swimming machine. The edges between swimming pool interior walls and the decks of swimming pools frequently have a coping or other edge treatments, which can complicate retrofitting of a swimming machine to an existing swimming pool. The two tubular rails are adapted to be attached to the swimming pool deck and provide clearance from the edge, avoiding this problem.

The use of a hydraulic motor to turn the impeller requires that a hydraulic feed line and a hydraulic return line be provided to serve the hydraulic motor. The use of the two tubular rails allows the hydraulic feed and return lines to be concealed within the two tubular rails and hence hidden from view.

The configuration of the tubular rails also serves to cushion the swimming machine and the swimming pool from the forces created by the swimming machine. The impeller for the swimming machine is mounted in the swimming machine substantially parallel to the surface of the water in the pool. When the impeller is turned by the hydraulic motor, the impeller drives the current of water upward and places a corresponding downward force on the swimming machine. Vanes turn the current of water and direct the current parallel to the surface of the water in the pool. The current of water exerts a force on the vanes driving the vanes (and hence the swimming machine) laterally toward the interior wall of the swimming pool. The downward force and the lateral force are resisted by the two tubular rails. The tubular rails act as a suspension system and cooperate to deform elastically under the downward force of the impeller and the lateral force of the vanes, dampening and cushioning the effect of those loads on the support structures of the swimming machine.

The swimming machine is not mounted rigidly to an interior wall of the pool. Instead, the lower end of the housing of the swimming machine is equipped with two wheels or rollers that engage the interior wall of the swimming pool when the swimming machine is operating. When the two rails deform elastically in response to the forces exerted by the impeller, the swimming machine moves downward on the interior wall of the swimming pool in response to the downward force and is pressed against the interior wall by the lateral force. The two wheels roll on the interior wall of the pool, preventing damage to the interior wall of the swimming pool from the forces and motion of the swimming machine.

The two wheels and the configuration of the tubular rails also allow the swimming machine to be readily moved from place to place by one person. When the swimming machine is not installed in the swimming pool, the wheels may support the swimming machine and the tubular rails may serve as handles to allow the swimming machine to be rolled from place to place, much like a hand truck. The swimming machine therefore may be readily moved to a storage or service location.

The expected principal use of the swimming machine of the Invention is to retrofit existing swimming pools to allow swimming-in-place. The swimming machine of the Invention also may be incorporated into the design of new swimming pools.

III. BRIEF DESCRIPTION OF THE FIGURES

IV. DESCRIPTION OF AN EMBODIMENT

Figure 1:
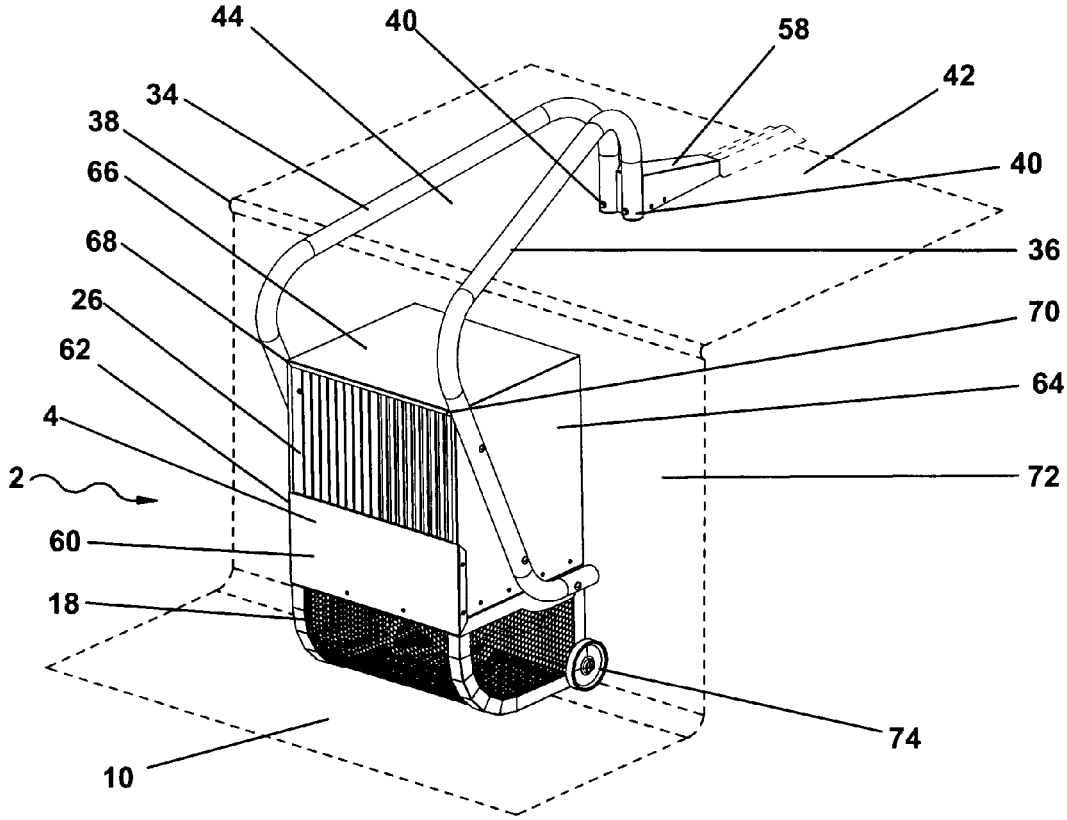
FIG. 1 is a perspective view of the swimming machine of the Invention showing the configuration of the rails.
Figure 2:
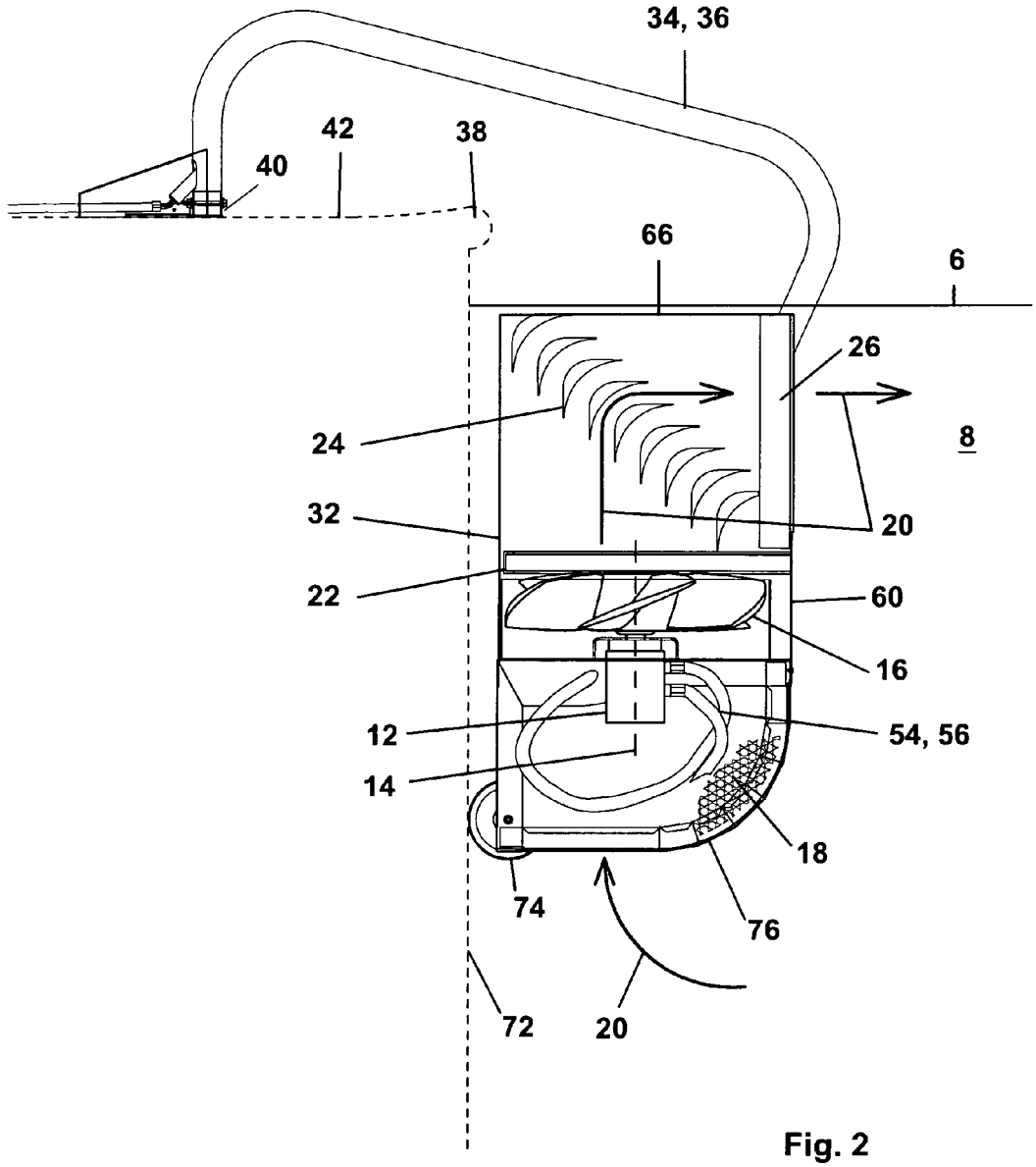
FIG. 2 is a partial cut away side view of the swimming machine in place in a swimming pool.

As shown by FIGS. 1 and 2, the swimming machine 2 of the Invention includes a housing 4. The housing 4 is supported below the surface 6 of water 8 in a swimming pool 10. A hydraulic motor 12 is supported by housing 4.

The hydraulic motor 12 has an axis of rotation 14 that is substantially vertical and thus normal to the surface 6 of water 8. An impeller 16 is rotated by hydraulic motor 12. Impeller 16 draws water 8 through intake screen 18. A current 20 of water 8 is expelled by the impeller 16 in a substantially vertical direction. The current 20 passes through first flow straightener 22, which reduces turbulence. The current 20 then is turned by vanes 24 so that the direction of flow of the current 20 is substantially parallel to surface 6 of water 8. The current 20 passes through second flow straightener 26, reducing the turbulence of the current 20. The current 20 exits the swimming machine 2 and travels through the water 8 of the swimming pool 10. A person may swim in place in the current 20.

Figure 3:
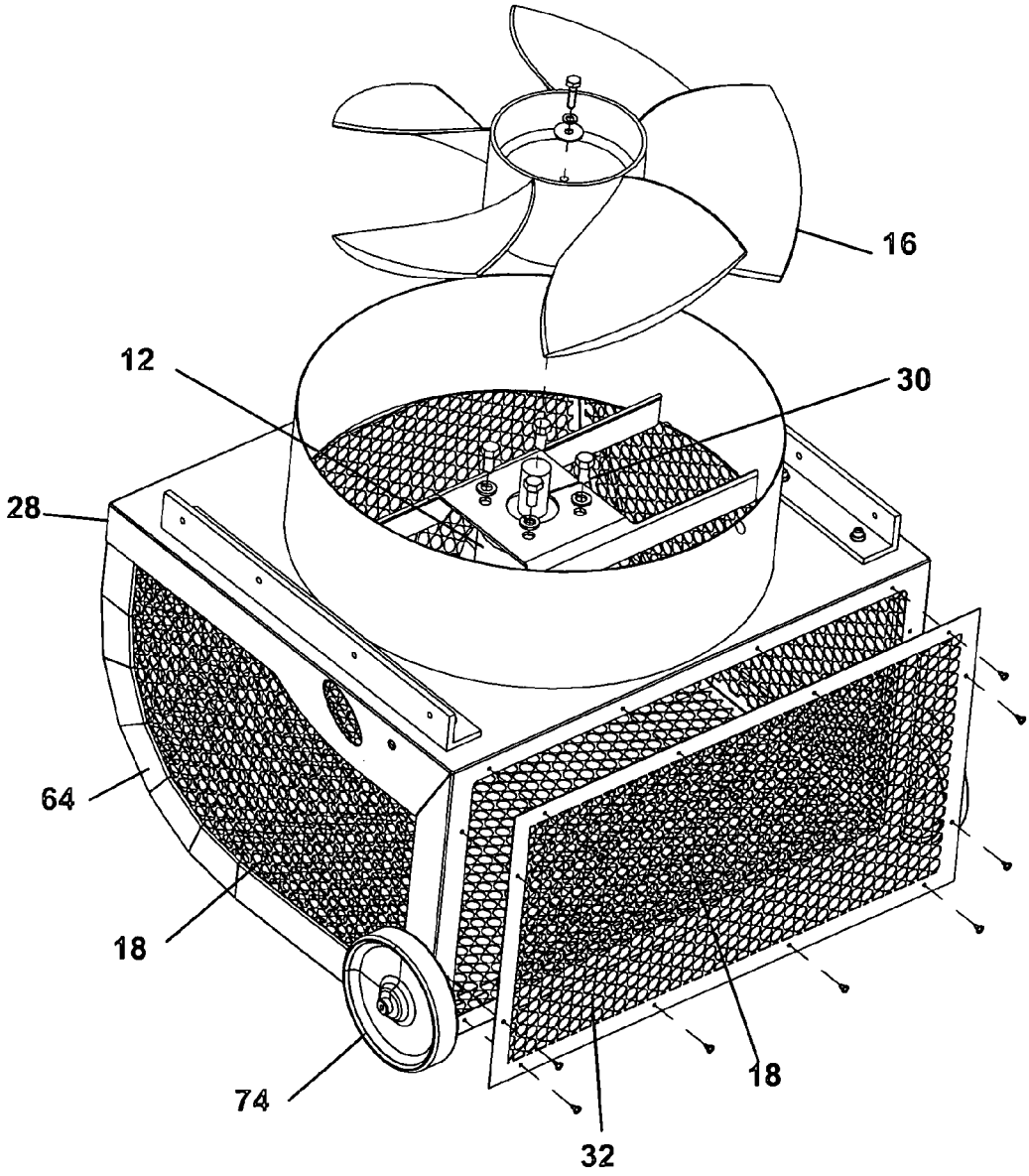
FIG. 3 is a detail exploded view of the intake screen, hydraulic motor and impeller.

FIG. 3 illustrates the mounting of the hydraulic motor 12 within the water intake portion 28 of the housing 4. The impeller 16 is mounted to the output shaft 30 of hydraulic motor 12. The water intake portion 28 of housing 4 includes intake screens 18 on the back side 32 and at least one other side. Inclusion of intake screens 18 on at least two sides avoids issues of entrapment. Hydraulic motor 12 preferably is surrounded by intake screens 18 on five sides, as shown by FIG. 3.

Figure 4:
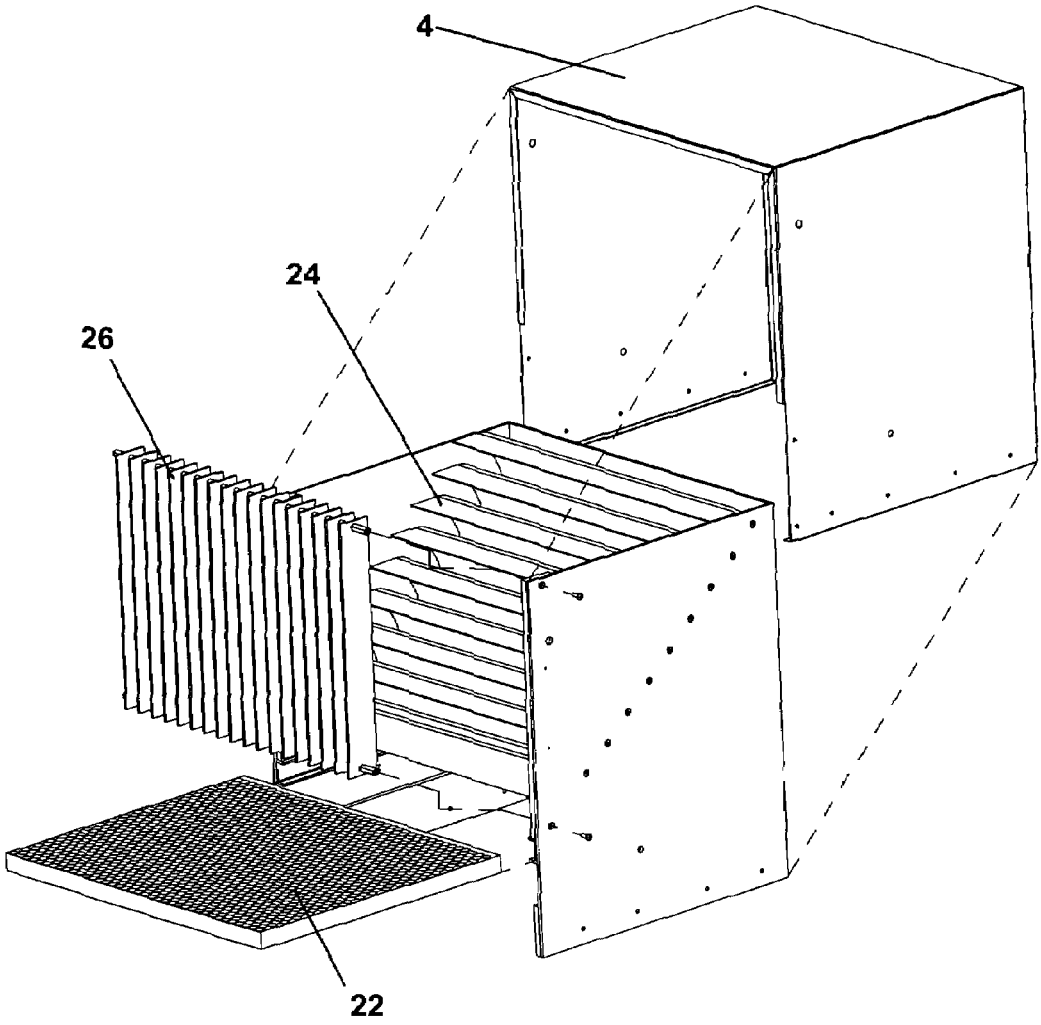
FIG. 4 is a detail exploded view of the housing, vanes and flow straightener.

FIG. 4 shows the mounting of the vanes 24, the first flow straightener 22 and the second flow straightener 26 within the housing 4. The first flow straightener 22 receives the current 20 of water 8 from the impeller 16 and reduces the turbulence of the water 8. The vanes 24 turn the flow substantially parallel to the water 8 surface 6. The second flow straightener 26 reduces the turbulence of the water 8 prior to discharging the current 20 of water 8 into the swimming pool 10.

As shown by FIGS. 1, 2, 5, and 6 the swimming machine 2 is supported within the swimming pool 10 by a first tubular rail 34 and a second tubular rail 36. First and second tubular rails 34, 36 are configured to resemble the rails of a conventional swimming pool ladder. The swimming machine 2 therefore will blend into the expected appearance of the swimming pool 10. The specific configuration of first and second tubular rails 34, 36 may be selected to match the appearance of the ladders of the specific swimming pool 10 into which the swimming machine 2 is to be installed. Configuration of the first and second tubular rails 34, 36 to resemble a swimming pool ladder also allows the swimming machine 2 to be retrofitted to an existing swimming pool 10 while avoiding contact or other interference with a coping 38 or other edge structure of the swimming pool 10.

First and second tubular rails 34, 36 each has a first end 40. First ends 40 are adapted to be attached to the deck 42 of the swimming pool 10. First and second tubular rails 34, 36 are configured to discourage entry to the portion 44 of the pool deck 42 between the first and second tubular rails 34, 36 and proximal to the housing 4. That portion 44 of the pool deck 42 is indicated on FIGS. 1 and 6. The goal is not to entirely exclude persons, such as children, from the portion 44 of the pool deck 42 between the first and second tubular rails 34, 36. The goal is to prevent a person from mistaking the first and second tubular rails 34, 36 as the railings of a swimming pool ladder. First and second tubular rails 34, 36 accomplish that goal by defining a barrier location 46 (shown by FIG. 6) on both first and second tubular rails 34, 36. The distance between the barrier locations 46 defines a separation distance 48 between the barrier locations 46 somewhere along the length of tubular rails 34, 36 above the water 8 surface 6. The separation distance 48 is selected to be too small for a person to pass through. In the embodiment illustrated by FIGS. 1, 5 and 6, first ends 40 are adapted to be mounted adjacent one to the other, thereby preventing persons from passing between first and second tubular rails 34, 36.

Figure 5:
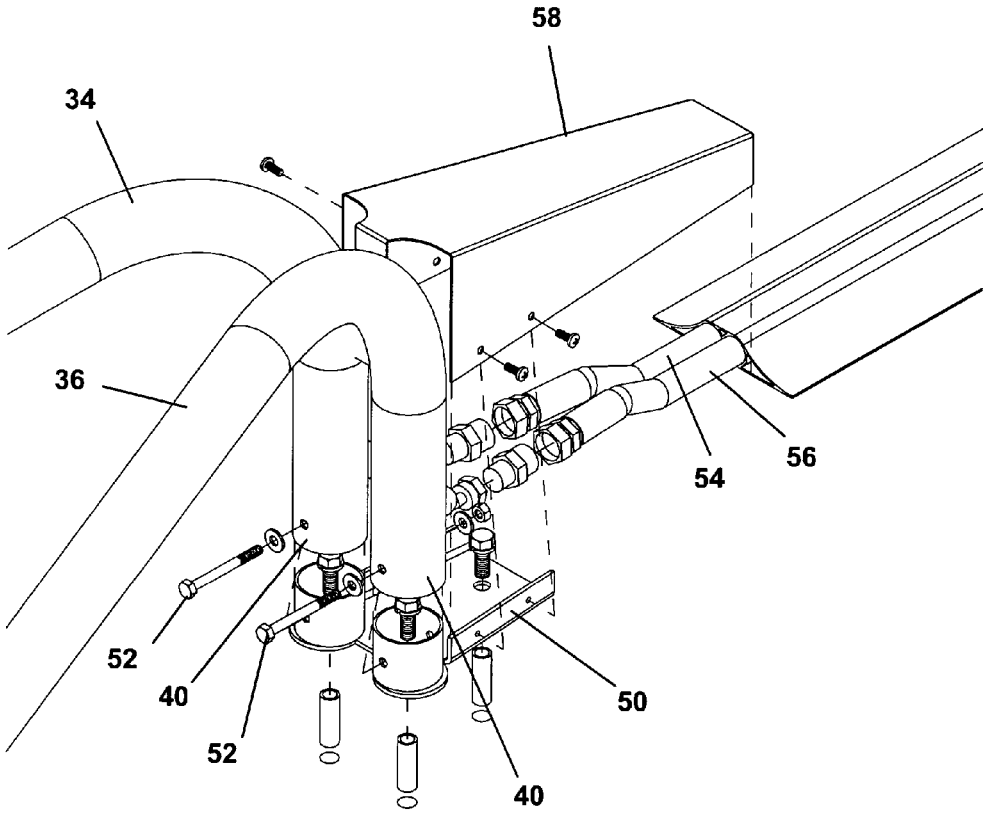
FIG. 5 is a detail exploded view of the swimming pool deck mounting.
Figure 6:
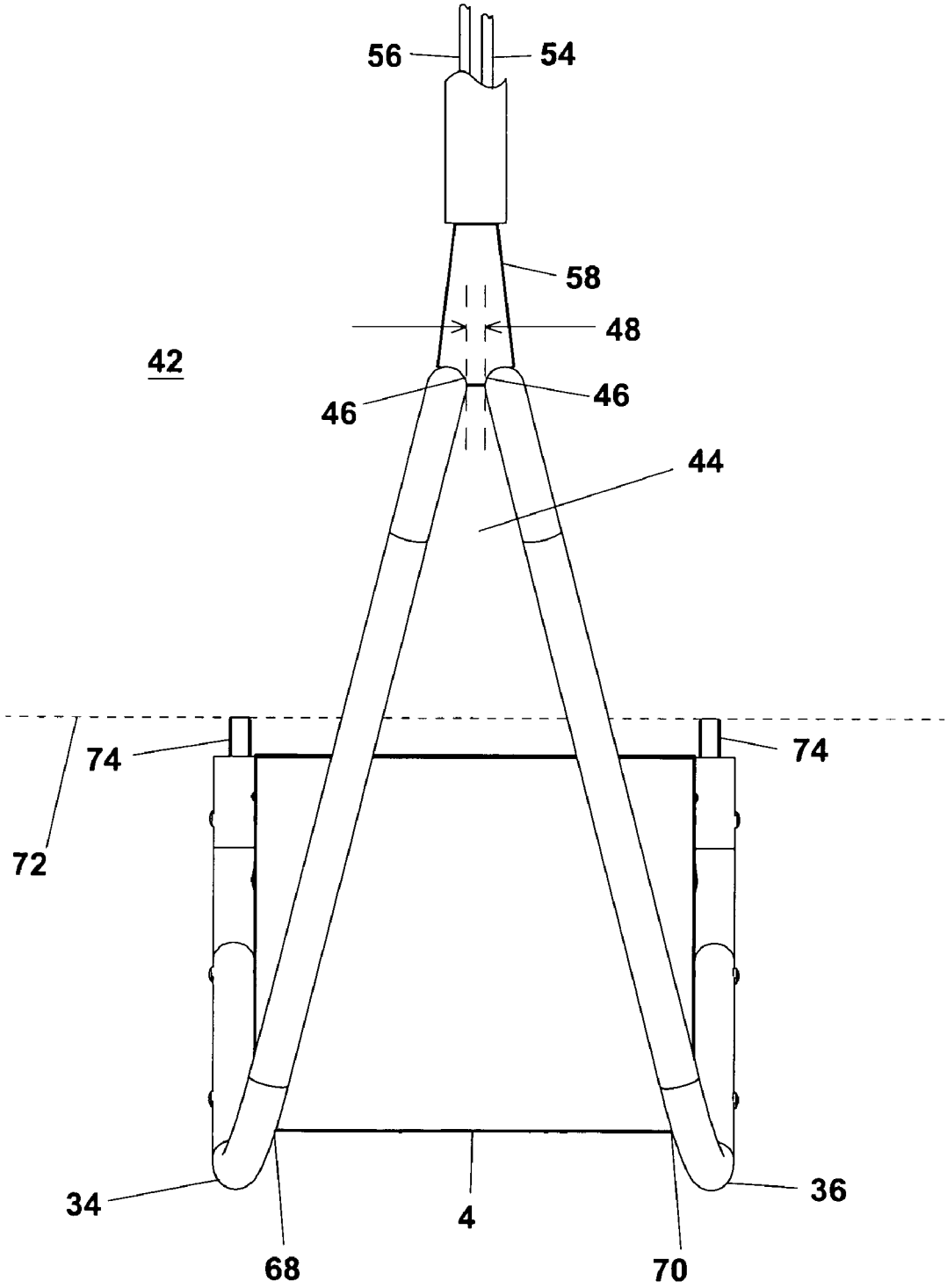
FIG. 6 is a top view of the Invention.

As shown by FIG. 5, a mounting bracket 50 is bolted to the deck 42 of a swimming pool 10. First ends 40 of both the first and second tubular rails 34, 36 are retained on the swimming pool 10 deck 42 mounting bracket 50 by through bolts 52. A hydraulic feed line 54 and a hydraulic return line 56 enter the first and second tubular rails 34, 36 at the swimming pool deck 42 mounting bracket 50 and pass through the first and second tubular rails 34, 36 to the hydraulic motor 12. An escutcheon cover 58 covers the hydraulic and bolt connections for a finished appearance.

As shown by FIG. 1, housing 4 has a front side 60, a first side 62, a second side 64 and a top side 66. First and second rails each engage one of first side 62 and second side 64. Housing 4 has a first top corner 68 defined by the intersection of the front side 60, top side 66 and first side 62. Housing 4 also has a second top corner 70 defined by the intersection of front side 60, second side 64 and top side 66. First and second tubular rails 34, 36 engage first side 62 and second side 64 at a location adjacent to first and second top corners 68, 70, thereby preventing a swimmer or other person from colliding with first and second top corners 68, 70.

When the swimming machine 2 is mounted in a swimming pool 10 and hydraulic motor 12 is driving impeller 16, impeller 16 will exert force on the housing 4 driving the housing 4 deeper into the water 8. The first and second tubular rails 34, 36 resist the force of the impeller 16; however, the first and second tubular rails 34, 36 have resilience and the housing 4 will move in response to the force of the impeller 16. The force exerted by the impeller 16 also will tend to rotate the swimming machine 2 around the connection between the first ends 40 of first and second tubular rails 34, 36 and the swimming pool deck 42 and will push the housing 4 against the interior wall 72 of the swimming pool 10. Each of a pair of rotatable wheels 74 is mounted to housing 4 and extends beyond back side 32 and bottom side 76 of housing 4. By extending beyond back side 32, wheels 74 engage and roll on interior wall 72 of swimming pool 10 in response to motion of the housing 4, thereby preventing damage to the swimming pool interior wall 72.

Figure 7:
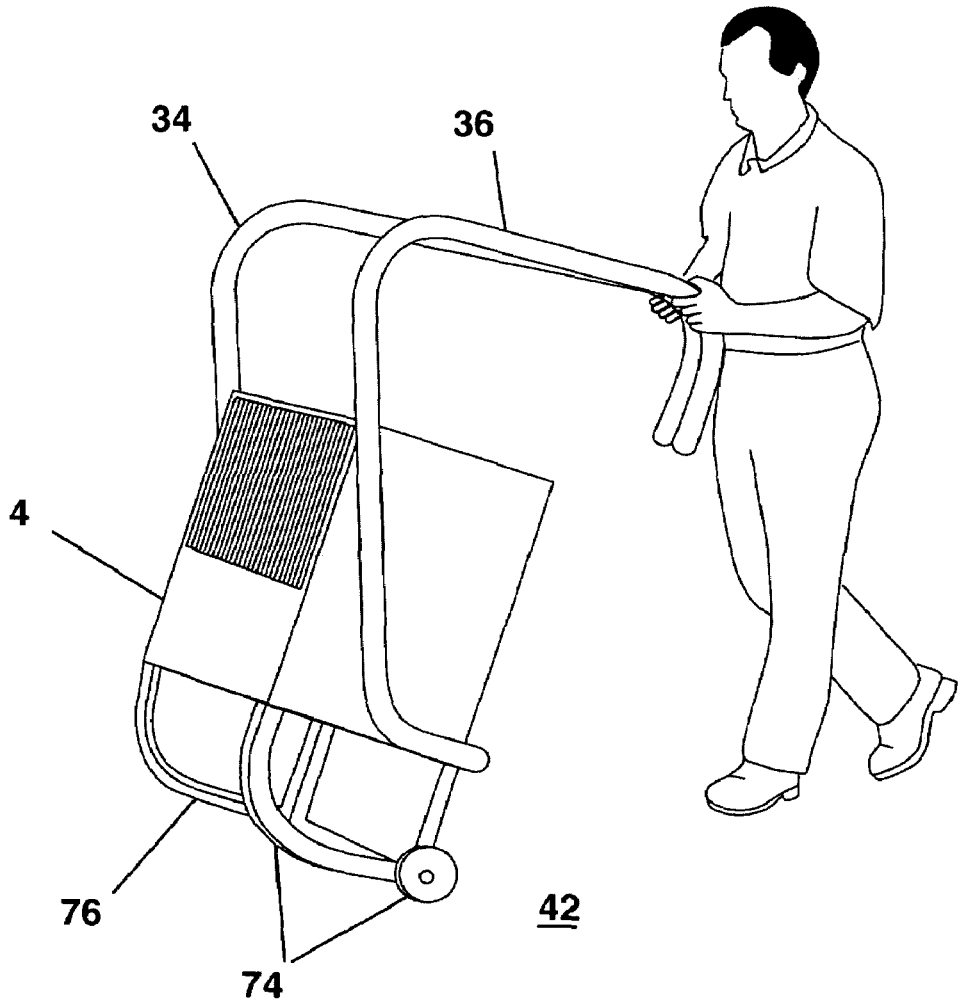
FIG. 7 is a perspective view of the Invention being moved on a swimming pool deck.

As shown by FIG. 7, by extending the pair of wheels 74 below the bottom side 76 of the housing 4, the swimming machine 2 may be moved about on a swimming pool 10 deck 42. A user grips the first and second tubular rails 34, 36 and rolls the swimming machine 2 on the wheels 74 much as one would roll a hand truck. The user may readily remove the swimming machine 2 from the swimming pool 10 for service or storage by disconnecting the hydraulic lines, removing the through bolts 52 at the first ends 40 of tubular rails 34, 36, pulling the swimming machine 2 from the water 8 and rolling the swimming machine 2 to a storage or service location. The user may reverse the process to reinstall the swimming machine 2.

Figure 8:
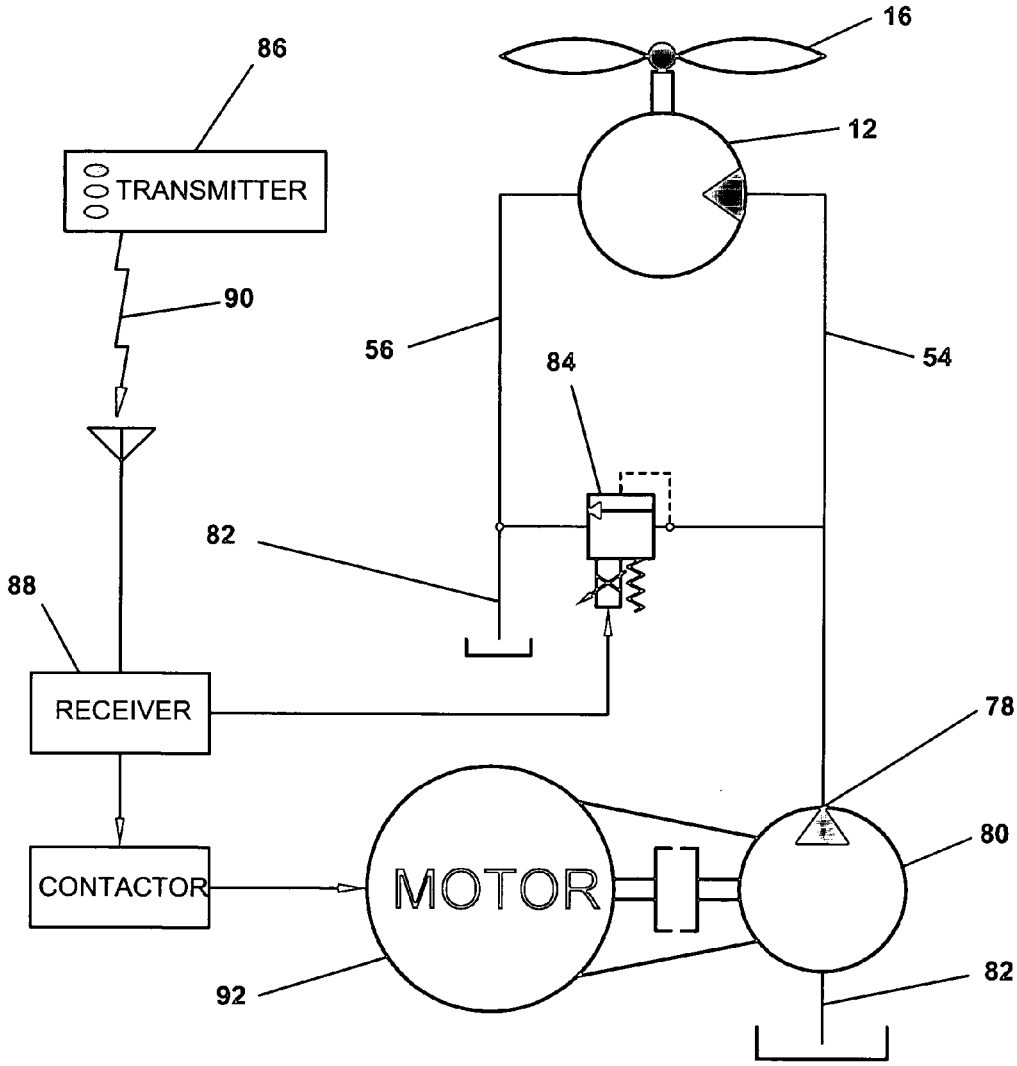
FIG. 8 is a diagram of the hydraulic circuit of the Invention showing the control system.

The hydraulic and control systems are illustrated by FIG. 8. The hydraulic motor 12 is connected by a hydraulic feed line 54 to the high pressure side 78 of a hydraulic pump 80. The hydraulic pump 80 is powered by an electric motor 92. Use of a hydraulic drive system with a hydraulic pump 80 powered by an electric motor 92 and separated from the swimming pool 10 avoids any issues of electrical shock. A hydraulic return line 56 connects the motor 12 to the low pressure side 82 of the hydraulic pump 80. The hydraulic motor 12 is adapted for underwater service. The preferred hydraulic motor 12 requires three cubic inches of hydraulic fluid for one revolution of the hydraulic motor 12. The hydraulic pump 80 is driven by a conventional electrical motor 92 with a no-load speed of 1750 rpm. The preferred hydraulic pump 80 is selected to pump 0.7 cubic inches of hydraulic fluid for every rotation of the hydraulic pump 80.

A proportional relief valve 84 connects the hydraulic feed line 54 and the hydraulic return line 56. The proportional relief valve 84 allows a user-selectable amount of the hydraulic fluid to bypass the hydraulic motor 12, thereby controlling the speed and power output of the hydraulic motor 12 and the velocity of the current 20 of water 8 created by the impeller 16. The proportional relief valve 84 is electrically operated and controlled by a pulse-width modulated electrical signal. The proportional relief valve 84 preferably is a cartridge-style screw-in pilot-operated spool-type hydraulic relief valve. The proportional relief valve 84 can be infinitely adjusted across its adjustment range. The proportional relief valve 84 preferably has a manual override feature to allow the proportional relief valve 84 to be set manually when the electric signal is lost.

The proportional relief valve 84 is operated by a remote control transmitter 86 and a remote control receiver 88. The remote control transmitter 86 transmits a radio signal 90 that is picked up by a radio receiver 88. The radio receiver 88 interprets the radio signal 90 from the transmitter 86 and sends a signal to the proportional relief valve 84. The proportional relief valve 84 opens or closes proportionally to the signal received from the radio receiver 88, controlling the flow of hydraulic fluid through the hydraulic motor 12 and hence controlling the velocity of the water 8 exiting the swimming machine 2.

The remote control receiver 88 also controls a contactor controlling the supply of electricity to electrical motor 92. A person therefore may turn the electrical motor 92 on or off using the remote control transmitter 86.

The radio control transmitter 86 preferably is selected to transmit on a 433 MHz frequency using a SAW-based transmitter to satisfy U.S. and international radio spectrum regulations. The radio control receiver 88 preferably is programmable to remember the digital signature code of the remote control transmitter 86 so that the remote control receiver 88 will only accept authorized control signals. A radio transmitter 86 and receiver 88 combination with a range of about one hundred feet has proved successful in practice. Any of the alternatives to radio 90 remote control known in the art may be used, such as an optical remote control or a remote control utilizing sound or voice.

In use, a swimmer or another person may adjust the speed of rotation of the hydraulic motor 12 and hence the velocity of the current 20 of water 8 by pressing one or more buttons on the remote control transmitter 86. The swimmer has continuous control over the velocity of the water 8 but is isolated from the possibility of electrical shock by use of the hydraulic power transmission system and the remote control transmitter 86.

As illustrated by FIGS. 1, 2 and 3, intake screen 18 appears on the front side 60, first side 62, second side 64, back side 32 and bottom side 76 of intake portion 28 of housing 4. Intake screen 18 curves from front side 60 along first and second sides 62, 64. The grill of intake screen 18 is selected to have 80% of the grill open to provide for unimpeded flow of water through the intake screen 18. The intake screen 18 prevents a swimmer or objects in the swimming pool 10 from becoming entangled in or otherwise contacting the impeller 16. Providing intake screen 18 on the back side 32 of housing 4 is a safety feature and prevents a swimmer from becoming entrapped against the intake screen below the surface 6 of water 8.

In describing the above embodiments of the invention, specific terminology was selected for the sake of clarity. However, the invention is not intended to be limited to the specific terms so selected, and it is to be understood that each specific term includes all technical equivalents that operate in a similar manner to accomplish a similar purpose.

We claim:

1. A swimming machine comprising:

a. a housing adapted to be mounted substantially under a surface of a water within a swimming pool;

b. an impeller supported within said housing:

c. a hydraulic motor attached to said impeller and adapted to rotate said impeller, said rotation of said impeller creating a current of said water when said housing is supported substantially under said surface of said water and said hydraulic motor is rotating said impeller;

d. a hydraulic pump operably connected to said hydraulic motor, said hydraulic pump having a high pressure side and a low pressure side;

e. a hydraulic valve operably interposed between said hydraulic pump and said hydraulic motor, said hydraulic valve being adapted to bleed a user selectable portion of a hydraulic fluid from said high pressure side to said low pressure side of said hydraulic pump, said user-selectable portion of said hydraulic fluid thereby bypassing said hydraulic motor, said hydraulic valve being a continuously variable valve or a stepped valve;

f. a remote control transmitter:

g. a remote control receiver, said remote control receiver being adapted to be operated by said remote control transmitter, said remote control receiver being adapted to operate said hydraulic valve, whereby said remote control transmitter selectably controls said speed of rotation of said impeller, wherein said remote control transmitter is adapted to selectably transmit a radio signal, said remote control receiver being adapted to receive said radio signal, said remote control receiver being adapted to respond to said radio signal to operate said hydraulic valve;

h. a first tubular rail and a second tubular rail, said first and said second tubular rails engaging said housing, said first and said second tubular rails being adapted to support said housing against a pull of gravity and against a force exerted by said impeller when said housing is installed in said swimming pool and said impeller is rotating, each of said first and said second tubular rails having a first end, said first ends of said first and said second tubular rails being adapted to engage a deck of said swimming pool, said first and said second tubular rails being configured to define a barrier, said barrier being adapted to substantially discourage entry to a location on said deck between said first and said second tubular rails and proximal to said housing when said housing is installed in said swimming pool, said first and said second tubular rails in combination being configured to define a barrier location, said first and said second tubular rails defining a separation distance at said barrier location, said separation distance being selected so that a person may not pass between said first and said second tubular rails at said barrier location, said barrier location being located between said first ends of said first and said second tubular rails and said surface of said water when said housing is installed in said swimming pool, said housing having a first side, a second side, a first top corner and a second top corner, said first and said second top corners being distal to said wall of said pool when said housing is installed within said swimming pool, said first and said second tubular rails being adapted to prevent a person from colliding with said first top corner and said second top corner, said adaptation of said first and said second tubular rails to prevent said person from colliding with said first and said second top corners comprising: said first tubular rail engaging said first side of said housing, said second tubular rail engaging said second side of said housing, said first tubular rail being located adjacent to said first top corner, said second tubular rail being located adjacent to said second top corner.

2. The swimming machine of claim 1 further comprising: a hydraulic feed line and a hydraulic return line, said hydraulic feed line being adapted to receive said hydraulic fluid from said hydraulic pump and to transmit said hydraulic fluid to said hydraulic motor, said hydraulic return line being adapted to receive said hydraulic fluid from said hydraulic motor and return said hydraulic fluid to said hydraulic pump, said hydraulic feed line being located within one of said first and said second tubular rails, the hydraulic return line being located within the other of said first and said second tubular rails.

3. The swimming machine of claim 2, further comprising: a first wheel and a second wheel, said housing having a bottom side and a back side, said first wheel and said second wheel engaging said housing in a spaced-apart relation proximal to said bottom side and said back side of said housing, said first and said second wheels being adapted to rotatably engage said interior wall of said pool and to prevent direct engagement between said back side of said housing and said interior wall of said swimming pool when said housing is installed in said swimming pool, said first and said second wheels being adapted to rotatably engage said swimming pool deck and to prevent direct engagement between said bottom side of said housing and said swimming pool deck when said housing is being moved on said swimming pool deck by said person gripping said first and said second tubular rails.

4. The swimming machine of claim 3, further comprising: a mounting bracket, said mounting bracket being adapted to be attached to said swimming pool deck, said mounting bracket being adapted to receive and to retain said first end of said first tubular rail and said first end of said second tubular rail, said first end of said first tubular rail being substantially adjacent to said first end of said second tubular rail, said barrier location being defined by said first end of said first tubular rail and said first end of said second tubular rail.

5. The swimming machine of claim 4 further comprising:

a. an intake screen, said housing having a front side and a top side, said intake screen appearing on said back side of said housing and on at Least one other of said front side, said first side, said second side and said bottom side of said housing;

b. said impeller having an axis of rotation, said axis of rotation being disposed substantially normal to said surface of said water when said housing is installed in said swimming pool, said impeller being adapted to receive said water through said intake screen and to direct a current of said water toward said surface of said water in said swimming pool when said housing is substantially located below said surface of said water in said swimming pool and said impeller is rotating;

c. A plurality of vanes, said vanes being contained within said housing, said vanes receiving said current of said water from said impeller and directing said current in a direction parallel to said surface of said water when said housing is installed in said swimming pool and said impeller is rotating;

d. A flow straightener, said flow straightener appearing on said front side of said housing, said flow straightener being adapted to receive said current of said water from said plurality of vanes and to transmit said current of said water into said swimming pool when said housing is installed in said swimming pool and said impeller is rotating.

6. A swimming machine comprising:

a. a housing adapted to be mounted substantially under a surface of a water within a swimming pool:

b. an impeller supported within said housing;

c. a hydraulic motor attached to said impeller and adapted to rotate said impeller, said rotation of said impeller creating a current of said water when said housing is supported substantially under said surface of said water and said hydraulic motor is rotating said impeller;

d. a hydraulic pump operably connected to said hydraulic motor, said hydraulic pump having a high pressure side and a low pressure side;

e. a hydraulic valve operably interposed between said hydraulic pump and said hydraulic motor, said hydraulic valve being adapted to bleed a user- selectable portion of a hydraulic fluid from said high pressure side to said low pressure side of said hydraulic pump, said user-selectable portion of said hydraulic fluid thereby bypassing said hydraulic motor;

f. a first and a second tubular rail, said first and said second tubular rails engaging said housing, said first and said second tubular rails being adapted to support said housing against a null of gravity and against a force exerted by said impeller when said housing is installed in said swimming pool and said impeller is rotating, each of said first and said second tubular rails having a first end, said first end of said first and said second tubular rails being adapted to engage a deck of said swimming pool, said first and said second tubular rails substantially defining a barrier to entry to a location on said deck between said first and said second tubular rails and adjacent to said housing when said housing is installed in said swimming pool, said first and said second tubular rails in combination being configured to define a barrier location, said first and said second tubular rails defining a separation distance at said barrier location, said separation distance being selected so that a person may not pass between said first and said second tubular rails at said barrier location, said barrier location being located between said first ends of said first and said second tubular rails and said surface of said water when said housing is installed in said swimming pool, said housing haying a first side, a second side, a first top corner and a second top corner, said first and said second top corners being distal to said wall of said pool when said housing is installed within said swimming pool, said first tubular rail engaging said first side of said housing, said second tubular rail engaging said second side of said housing, said first tubular rail being located adjacent to said first top corner, said second tubular rail being adjacent to said second top corner, whereby said first and said second tubular rails prevent a person from colliding with said first and said second top corners of said housing.

7. The swimming machine of claim 6 further comprising: a hydraulic feed line and a hydraulic return line, said hydraulic feed line being adapted to receive said hydraulic fluid from said hydraulic pump and to transmit said hydraulic fluid to said hydraulic motor, said hydraulic return line being adapted to receive said hydraulic fluid from said hydraulic motor and return said hydraulic fluid to said hydraulic pump, said hydraulic feed line being located within one of said first and said second tubular rails, the hydraulic return line being located within the other of said first and said second tubular rails.

8. The swimming machine of claim 7, further comprising: a first wheel and a second wheel, said housing having a bottom side and a back side, said first wheel and said second wheel engaging said housing in a spaced-apart relation proximal to said bottom side and said back side of said housing, said first and said second wheels being adapted to rotatably engage said interior wall of said pool and to prevent direct engagement between said back side of said housing and said interior wall of said swimming pool when said housing is installed in said swimming pool, said first and said second wheels being adapted to rotatably engage said swimming pool deck and to prevent direct engagement between said bottom side of said housing and said swimming pool deck when said housing is being moved on said swimming pool deck by said person gripping said first and said second tubular rails.

9. The swimming machine of claim 8, further comprising: a mounting bracket, said mounting bracket being adapted to be attached to said swimming pool deck, said mounting bracket being adapted to receive and to retain said first end of said first tubular rail and said first end of said second tubular rail, said first end of said first tubular rail being located substantially adjacent to said first end of said second tubular rail, said first ends of said first and said second tubular rails substantially defining said barrier location.

10. The swimming machine of claim 9, further comprising:

a. a remote control transmitter;

b. a remote control receiver, said remote control receiver being adapted to be operated by a remote control transmitter, said remote control receiver being adapted to operate said hydraulic valve, whereby said remote control transmitter selectably controls said speed of rotation of said impeller.

11. The swimming machine of claim 10 wherein a. said remote control transmitter is adapted to selectably transmit a radio signal, said remote control receiver being adapted to receive said radio signal, said remote control receiver being adapted to respond to said radio signal to operate said hydraulic valve, and b. said hydraulic valve is a continuously variable valve or a stepped valve.

12. The swimming machine of claim 11 further comprising:

a. an intake screen, said housing having a front side and a top side, said intake screen appearing on said back side of said housing and on at least one other of said front side, said first side, said second side and said bottom side of said housing;

b. said impeller having an axis of rotation, said axis of rotation being disposed substantially normal to said surface of said water when said housing is installed in said swimming pool, said impeller being adapted to receive said water through said intake screen and to direct a current of said water toward said surface of said water in said swimming pool when said housing is substantially located below said surface of said water in said swimming pool and said impeller is rotating;

c. A plurality of vanes, said vanes being contained within said housing, said vanes receiving said current of said water from said impeller and directing said current in a direction parallel to said surface of said water when said housing is installed in said swimming pool and said impeller is rotating;

d. A flow straightener, said flow straightener appearing on said front side of said housing, said flow straightener being adapted to receive said current of said water from said plurality of vanes and to transmit said current of said water into said swimming pool when said housing is installed in said swimming pool and said impeller is rotating.

* * * * *